US006380900B1

(12) United States Patent
Kanayama

(10) Patent No.: US 6,380,900 B1
(45) Date of Patent: Apr. 30, 2002

(54) ANTENNA APPARATUS AND WIRELESS COMMUNICATION APPARATUS

(75) Inventor: Yoshiki Kanayama, Saitama (JP)

(73) Assignee: Sony Corporation, Tokyo (JP)

( * ) Notice: Subject to any disclaimer, the term of this patent is extended or adjusted under 35 U.S.C. 154(b) by 0 days.

(21) Appl. No.: 09/809,928

(22) Filed: Mar. 16, 2001

(30) Foreign Application Priority Data

Mar. 21, 2000 (JP) ..... 2000-083275

(51) Int. Cl.[7] ..... H01Q 1/24
(52) U.S. Cl. ..... 343/702; 343/895
(58) Field of Search ..... 343/702, 725, 343/729, 718, 872, 700 MS, 895

(56) References Cited

U.S. PATENT DOCUMENTS 5,771,466 A * 6/1998 Tsugane et al. ..... 455/90
5,959,116 A * 9/1999 Baro ..... 455/90
6,031,496 A * 2/2000 Kuittine et al. ..... 343/702
6,069,592 A * 5/2000 Wass ..... 343/895
6,249,255 B1 * 6/2001 Eggleston ..... 343/702
6,255,996 B1 * 7/2001 Wallace ..... 343/702

* cited by examiner

*Primary Examiner*—Tan Ho
(74) *Attorney, Agent, or Firm*—Jay H. Maioli

(57) ABSTRACT

An antenna apparatus and a wireless communication apparatus are proposed by the present invention to reduce an absorption factor of electromagnetic waves absorbed by a human body during the telephone call. By arranging antenna disposing means so as to dispose an antenna element indicating a higher absorption factor the more distant from a human body on the basis of an absorption factor of electromagnetic waves absorbed by a human body, measured in advance when at least two or more antenna elements different in electrical length operate as antennas under the same disposing conditions, it is possible to reduce the absorption factor of electromagnetic waves absorbed by a human body during the telephone call in such a degree as to keep an antenna element indicating the higher absorption factor the more distant from the human body even if at least two or more antenna elements are disposed.

12 Claims, 11 Drawing Sheets

FIG. 18A
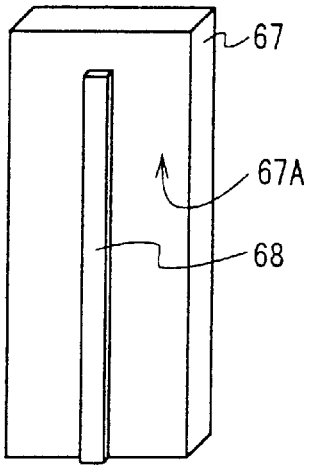
FIG. 18B
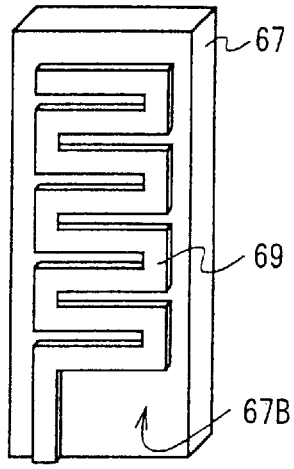
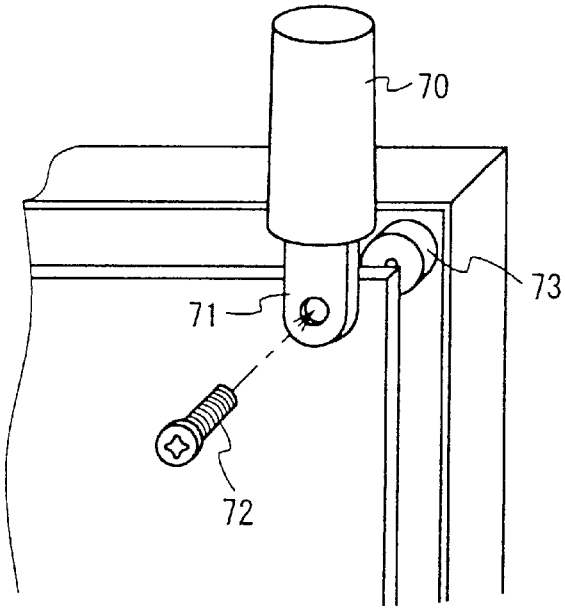
FIG. 19

ANTENNA APPARATUS AND WIRELESS COMMUNICATION APPARATUS

BACKGROUND OF THE INVENTION

1. Field of the Invention

The present invention relates to an antenna apparatus and a wireless communication apparatus, and more particularly is suitably applied to a cellular phone capable of using two types of wireless communication systems, for example, different in used wireless communication frequency.

2. Description of the Related Art

In recent years, cellular phones have a tendency to become insufficient in the number of lines only for a single wireless communication system with a rapid spread.

Accordingly, in cellular phones, it is considered that two types of wireless communication systems using different frequency bands are jointly used to ensure the required number of lines and there has been developed a terminal capable of using two types of wireless communication systems by,means of a single cellular phone.

Actual complex terminals include such as, in Japan a complex terminal jointly using two wireless communication systems of a Personal Digital Cellular (PDC) using an 800 MHz band and a Personal Handyphone Systems (PHS) using a 1.9 GHz band of wireless communication frequencies, in Europe a complex terminal jointly using two wireless communication systems of a Global System for Mobile Communication (GSM) using a 900 MHz band and a Digital Communication System (DCS) using a 1.8 GHz band, and in the United States of America a complex terminal jointly using two wireless communication systems of an Advanced Mobile Phone Service (AMPS) using an 800 MHz band and a Personal Communications Services (PCS) using a 1.9 GHz band.

And, among such cellular phones, there are those provided with two antenna apparatuses operating at first and second wireless communication frequencies different from each other and those provided with a single antenna apparatus having two types of first and second antenna elements integrated into one piece.

Here, in an antenna apparatus having first and second elements integrated into one piece, the first antenna element 1 and the second antenna element 2 are integrated by the electrical connection to an antenna feeding part 3 via a common feeding point as shown in FIG. 1.

In this antenna apparatus, the electrical length extending from an antenna feeding part 3 to the open end of the first antenna element 1 is chosen to the order of $\lambda/4$ of one of a first wireless communication frequency out of two types of first and second wireless communication frequencies and that extending from the antenna feeding part 3 to the other open end of the second antenna element 2 is chosen to the order of $\lambda/4$ of the other of the second wireless communication frequency lower than the first one, for example.

Thus, the first antenna element 1 resonates at the relevant first wireless communication frequency during the use of the first wireless communication frequency and the first antenna element 1 alone operates as the antenna because an excess of electrical length for resonance of the second antenna element 2 at the first wireless communication frequency prevents the second antenna element 2 from resonating.

Besides, the second antenna element 2 resonates at the relevant second wireless communication frequency during the use of the second wireless communication frequency and the second antenna element 2 alone operates as the antenna because a shortage of electrical length for resonance of the first antenna element 1 at the second wireless communication frequency prevents the first antenna element 1 from resonating.

Such being the case, a cellular phone provided with such an antenna apparatus selectively uses first and second antenna elements corresponding to the first wireless communication frequency and the second wireless communication frequency used and therefore two different types of wireless communication systems are so arranged as to be jointly employed.

Meanwhile, in recent years, the absorption factor of an electromagnetic wave per time and per mass at a specific region (chiefly head) of a human body has been defined as the local average Specific Absorption Rate (SAR) and it has been required to suppress a maximum of the local average SARs below a prescribed value among electromagnetic waves irradiated from the cellular phone.

Here, in a cellular phone, the electric power fed from the antenna feeding part to the antenna element serving for the chief irradiation source of electromagnetic waves differs depending on wireless communication frequency used in general and the electric field of electromagnetic waves irradiated from the antenna element becomes more intense with increasing electric power.

And, if an antenna element irradiating electromagnetic waves of a relatively strong electric field and another irradiating electromagnetic waves of a relatively weak electric field are respectively disposed the same distance apart from a human body, the disposition of the antenna element irradiating electromagnetic waves of a relatively strong electric field shows a tendency for the local average SAR to rise.

Furthermore, a distance between the antenna element and the human body is disposed to become shorten in accordance with a tendency of recent miniaturization light weight in the cellular phone, and thinness, and consequently, the more the antenna element approaches the human body, the more the local average Specific Absorption Rate (SAR) increases.

In the antenna apparatus mentioned above in FIG. 1, the first and second antenna elements 1 and 2 are glued to the outer periphery of an antenna casing (unillustrated) made of a cylindrical nonconductive material, the antenna casing is simply inserted in the casing case of the cellular phone (unillustrated) and no measure for suppressing the local average SAR is taken.

SUMMARY OF THE INVENTION

In view of the foregoing, an object of this invention is to provide an antenna apparatus and a wireless communication apparatus capable of reducing the absorption factor of electromagnetic waves absorbed by a human body during the telephone call even when at least two or more antenna elements are disposed.

The foregoing object and other objects of the invention have been achieved by the provision of an antenna apparatus and a wireless communication apparatus in which an antenna element indicating the higher absorption factor was disposed by antenna disposing means the more distant from a human body on the basis of the absorption factor of electromagnetic waves absorbed by the human body, measured in advance when at least two or more antenna elements different in electrical length operate respectively as antennas under the same disposing conditions.

Consequently, even if at least two or more antenna elements are disposed, the absorption factor of electromagnetic waves absorbed by a human body during the telephone call can be reduced in such a degree as to keep an antenna element indicating the higher absorption factor the more distant from the human body.

Besides, antenna hold means is so arranged as to collectively hold all individual antenna elements electrically connected to a common feeding point, at this time such positioning is made by antenna positioning means that antenna elements are arranged in the decreasing order of absorption factor and the installation posture of the antenna hold means is so regulated by the posture regulation means that an antenna element indicating the higher absorption factor is kept the most distant from a human body when installing the antenna hold means to the installation means.

Thus, all individual antenna elements can be so disposed that an antenna element indicating the higher absorption factor is securely kept the more distant from a human body.

The nature, principle and utility of the invention will become more apparent from the following detailed description when read in conjunction with the accompanying drawings in which like parts are designated by like reference numerals or characters.

BRIEF DESCRIPTION OF THE DRAWINGS

In the accompanying drawings:

FIGS. 18A and 18B are outline perspective views showing a configuration of an antenna hold substrate provided in an antenna casing according to another embodiment;

FIG. 19 is an outline perspective view serving to explain an installation of an antenna casing according to another embodiment;

DETAILED DESCRIPTION OF THE EMBODIMENT

Preferred embodiments of this invention will be described with reference to the accompanying drawings:

(1) First Embodiment

Figure 2:
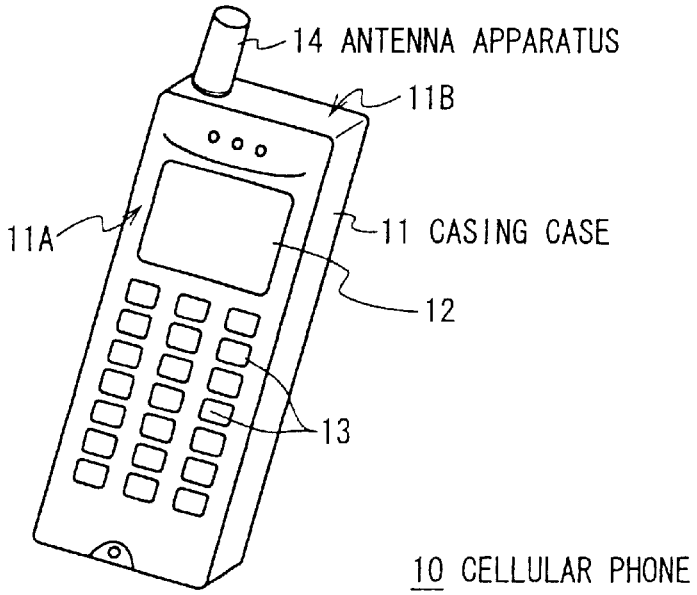
FIG. 2 is an outline perspective view showing a configuration of a cellular phone according to First Embodiment of the present invention.

In FIG. 2, reference numeral 10 denotes a cellular phone according to First Embodiment as a whole. This cellular phone comprises a liquid crystal panel 12 and a plurality of manipulation keys 13 located in the front surface 11A of a nonconductive casing case 11 and an antenna apparatus 14 inserted in the top end surface 11B of the casing case 11.

Figure 3:
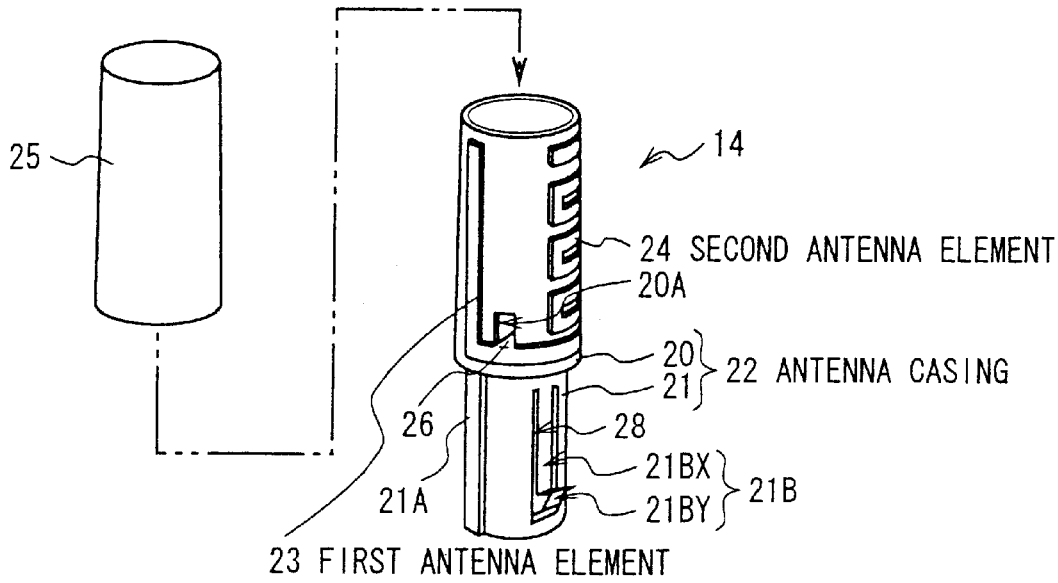
FIG. 3 is an outline perspective view showing a configuration of an antenna apparatus.

As shown in FIG. 3, the antenna apparatus 14 is provided with an antenna casing 22 comprising a cylindrical antenna bobbin 20 different in outside diameter and an insert part 21 integrally formed by a nonconductive material.

And, the outer periphery of the antenna bobbin 20, to which a first antenna element 23 operating as an antenna only at a first wireless communication frequency and a second antenna element 24 operating as another antenna only at a second wireless communication frequency among two different types of first and second wireless communication frequencies are glued in alignment along the peripheral direction, and is enveloped with a nonconductive antenna cover 25 so as to cover the first and the second antenna elements 23 and 24.

Figure 4:
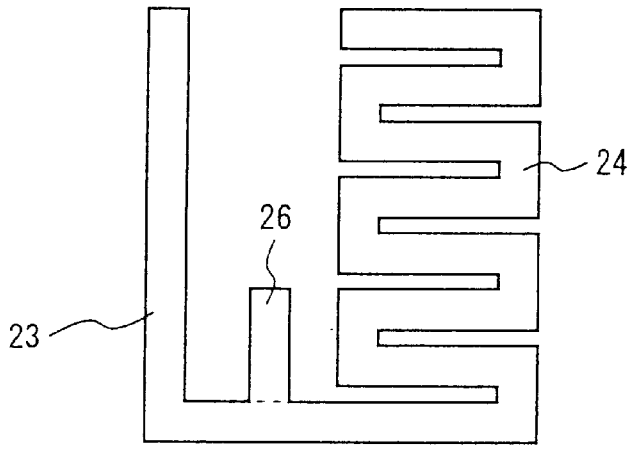
FIG. 4 is an outline plan view showing a configuration of first and second antenna elements.

Here, as shown in FIG. 4, the first antenna element 23 is formed of a conductive metal foil in the shape of a band, whereas the second antenna element 24 is formed of a conductive metal foil in the shape of a meander.

And, the first and the second antenna elements 23 and 24 are electrically connected to a common feeding point. A feeder line 26, formed of a conductive metal foil in the shape of a band, is electrically connected to the feeding point situated between them and they are integrally formed together with the feeder line 26.

Meanwhile, in this cellular phone 10, a local average SAR observed when the first and second antenna elements 23 and 24 operate as antennas at the actually corresponding first and second wireless communication frequencies is measured in advance under conditions that the first and the second antenna elements 23 and 24 are disposed the same distance apart from a human body (hereinafter, referred to as disposing conditions), then the first and the second antenna elements 23 and 24 are disposed on the basis of the measured result.

Here, the disposition of the first and the second antenna elements 23 and 24 will be explained below as attributable to a rise in local average SAR observed, for example, when the first antenna element 23 is operated as an antenna rather than the second antenna element 24 as a result of measuring a local average SAR under the same disposing conditions.

Namely, as shown in FIG. 3, the antenna bobbin 20 is provided with a line inserting hole part 20A bored near the border part with the insert part 21.

And, in the line inserting hole part 20A, a feeder line 26 bent at a nearly right angle to the first and the second antenna elements 23 and 24 is inserted, so that the first antenna element 23 indicating a relatively high local average SAR and the second antenna element 24 indicating a relatively low local average SAR are properly positioned and glued to the antenna bobbin 20.

Incidentally, in the antenna bobbin 20, since the first antenna element 23 and the second antenna element 24 are glued on the cylindrical outer periphery as to make the inserted surfaces opposed to each other, the outside diameter is minimized, thereby enabling the bobbin to be downsized.

Figure 5:
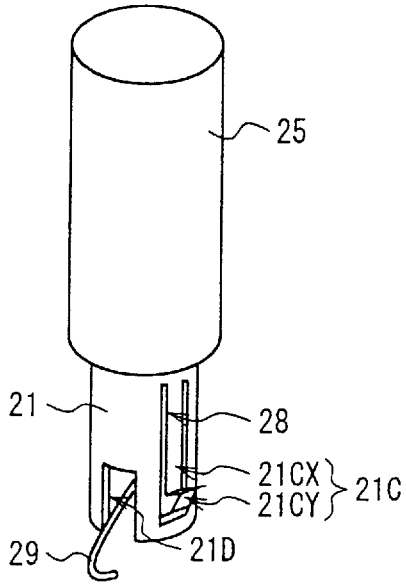
FIG. 5 is an outline perspective view showing a configuration of an antenna apparatus.

On the other hand, on the peripheral surface of an insert part 21, as shown in FIGS. 3 and 5, an insertion guide 21A nearly parallel with the center axis (unillustrated) of the insert part 21 is protrusively formed in conformity to the glued position of the first antenna element 23 in the antenna bobbin 20.

Besides, the insert part 21 has a slit 28 comprising a pair of U-shaped legs symmetric about its center axis formed, while insertion fixing parts 21B and 21C comprising part of the insert part 21 are provided as enclosed in the slit 28

The insertion fixing parts 21B and 21C have sheet springs 21BX and 21CX of a given length comprising the side wall of the insert part 21. Nails 21BY and 21CY are provided at the tip ends of the sheet springs 21BX and 21CX which protrude outward from the peripheral surface of the insert part 21.

And, because of having a given elasticity in the insertion fixing parts 21B and 21C, the sheet springs 21BX and 21CX are kept nearly parallel with the side wall of the insert part 21 under application of no external force. Even if a pressure is imposed so as to push the nails 21BY and 21CY into the insert part 21, the sheet springs 21BX and 21CX are recovered so as to become parallel with the side wall of the insert part 21 and the nails 21BY and 21CY are allowed so as to protrude outward from the peripheral surface of the insert part 21 after a release of the relevant pressure.

Furthermore, this insert part 21 has the notch part 21D formed in symmetry to the insertion guide 21A about its center axis, while one end side of a feeder spring 29 provided inside the antenna casing 22 and having a given elasticity protrudes outward through the notch part 21D.

Figure 6:
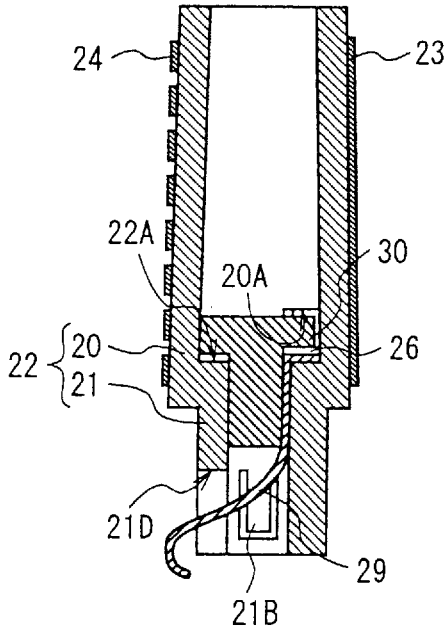
FIG. 6 is an outline sectional view serving to explain a connection between a feeder spring and a feeder line.

Actually, in the antenna casing 22, as shown in FIG. 6, the other end of the feeder spring 29 pulled inward is bent and pulled around to the line inserting hole part 20A over a step difference 22A between the interior of the antenna bobbin 20 and that of the insert part 21, so that the feeder line 26 inserted in the line inserting hole part 20A is placed on the other end of the feeder spring 29.

And, in the antenna casing 22, a bush 30 formed of an elastic member such as rubber in a T-shaped section is inserted in and mated with an extent from the interior of the antenna bobbin 20 to that of the insert part 21.

Consequently, in the antenna casing 22, the feeder line 26 is pushed by the bush 30 to the other end of the feeder spring 29 on the step difference 22A, thus electrically connecting and fixing the feeder spring 29 to the feeder line 26.

Figure 7A:
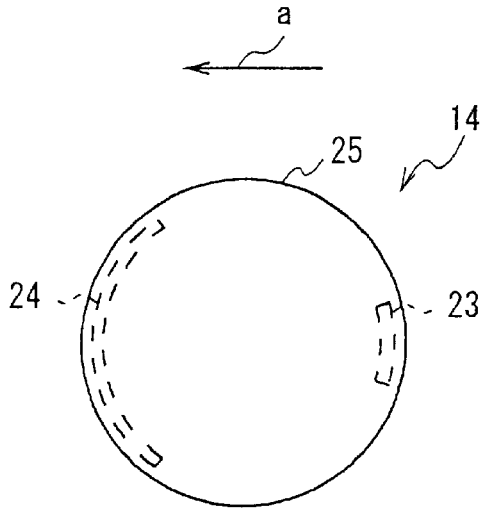
FIGS. 7A and 7B are outline top and bottom views serving to explain a disposition of first and second antenna elements in an antenna apparatus.
Figure 7B:
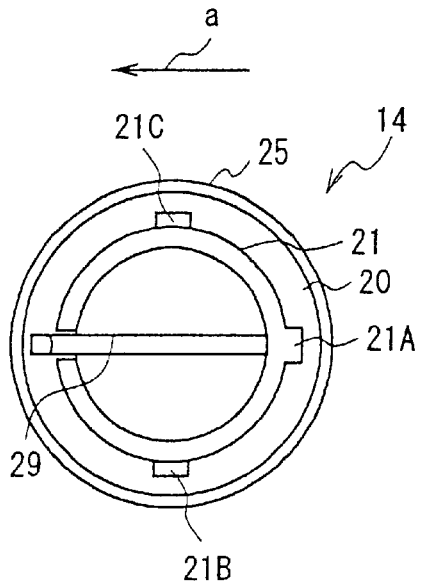

In this manner, with the antenna apparatus 14, the second antenna element 24 is disposed in the front side designated with the arrowhead a and the first antenna element 23 is disposed at the back side opposite the arrowhead a as shown in FIGS. 7A and 7B, if the antenna apparatus 14 observed from right above (FIG. 7A).

On the other hand, if the antenna apparatus 14 observed from right below (FIG. 7B), the notch part 21D is formed at the front side of the insert part 21, the insertion guide 21A is formed at the back side and the feeder spring 29 allows one end to protrude from the interior of the insert part 21 outward over an extent from the back side to the front side. Incidentally, the insertion fixing parts 21B and 21C are provided to the left and to the right of the insert part 21.

Figure 8:
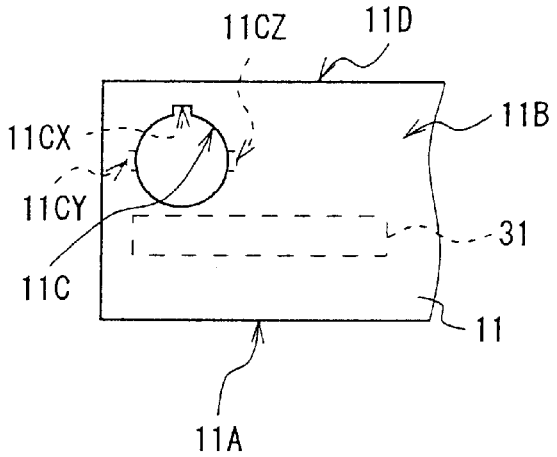
FIG. 8 is an outline top view showing a configuration of a casing case of a cellular phone.

In contrast, as shown in FIG. 8, the insert mount hole 11C responsive to the insert part 21 (FIG. 3) of the antenna casing 22 (FIG. 3) is provided near the side of a back surface 11D of the casing case 11 on the top end surface 11B of the casing case 11 of a cellular phone 10.

Besides, in the internal surface of the insert mount hole 11C, a guiding groove part 11CX responsive to the insertion guide 21A (FIG. 3) of the insert part 21 is provided along the depth of the insert mount hole 11C at the side of the back surface 11D of the casing case 11. Moreover, the hollow parts 11CY and 11CZ responsive to the nails 21BY and 21CY (FIGS. 3 and 5) of the insertion fixing parts 21B and 21C (FIGS. 3 and 5) of the relevant insert part 21 are provided to the right and to the left of the casing case 11.

Furthermore, inside this casing case 11, a circuit substrate 31 provided with an antenna feeder part (unillustrated) and a feeding electrode mentioned later, electrically connected to the antenna feeder part, are housed between the front surface 11A and the insert mount hole 11C.

Figure 9:
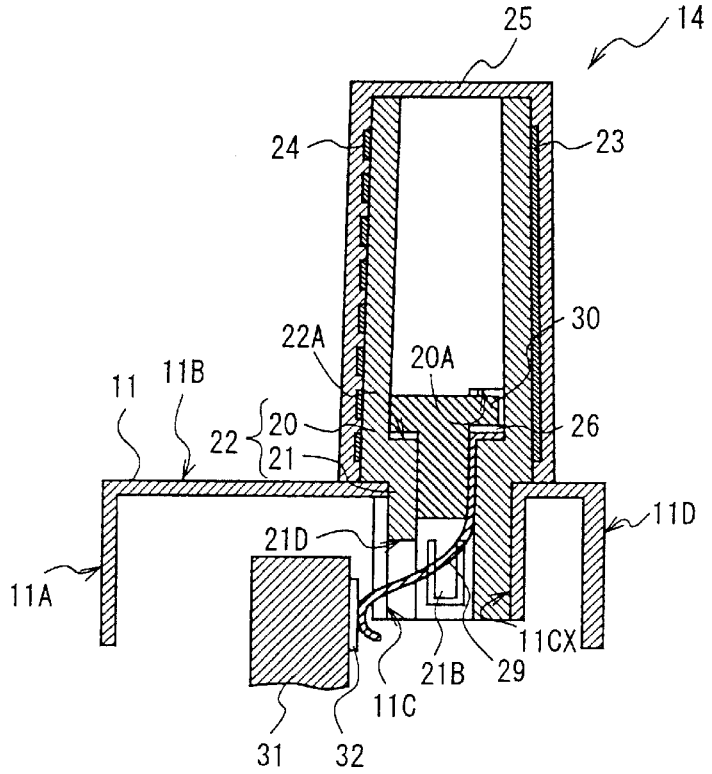
FIG. 9 is an outline sectional view serving to explain an insert mounting of the antenna apparatus to the casing case.

And, as shown in FIG. 9, the insert part 21 of the antenna casing 22 is put in the insert mount hole 11C by inserting the insertion guide 21A through the guiding groove part 11CX and the respective corresponding nails 21BY and 21CY of the insertion fixing parts 21B and 21C in the insert part 21 are mated with the hollow parts 11CY and 11CZ in the insert mount hole 11C, thereby enabling the antenna apparatus 14 to be inserted in and mounted on the casing case 11.

Besides, with the casing case 11, the housing position of the internal circuit substrate 31 is not only selected properly but the length of one end of the feeder spring 29 protruding outward from the insert part 21 of the antenna apparatus 14 is also selected properly, so that when the antenna apparatus 14 is inserted, one end side of the feeder spring 29 can be brought almost securely into butt contact against the feeding electrode 32 in one surface 31A of the circuit substrate 31. This enables the feeder spring 29 to be electrically connected to the feeding electrode 32.

Figure 1:
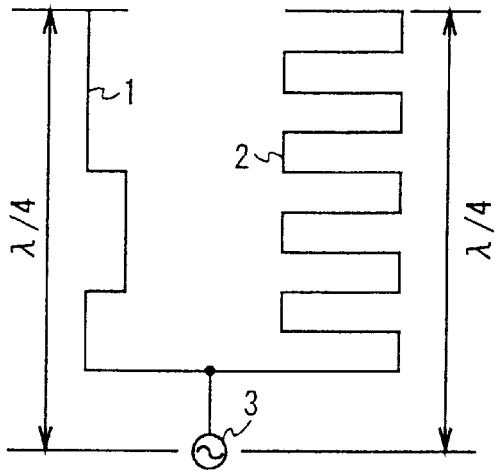
FIG. 1 (PRIOR ART)
FIG. 1 is an outline plan view showing a configuration of first and second antenna elements in a conventional antenna apparatus.

Meanwhile, with a conventional cellular phone provided with the antenna apparatus mentioned above by referring to FIG. 1, since the first antenna element 1 (FIG. 1) and the second one 2 (FIG. 1) are glued to the outer periphery of a cylindrical antenna casing and the cylindrical antenna casing is inserted in the casing case of the cellular phone without consideration of a local average SAR, there are some cases where the first or second antenna element 1 or 2 indicating a relatively high local average SAR under the same disposing conditions is disposed the nearest to a human body in the casing case.

In contrast, with a cellular phone 10 according to this Embodiment, a first antenna element 23 is so positioned relative to the antenna casing 22 of an antenna apparatus 14 as to be situated at its back surface side and the first and second antenna elements 22 and 23 are glued, and moreover the insertion posture of the antenna apparatus 14 is so regulated as to align the back surface side of the antenna casing 22 with that 11D of the casing case 11 also by inserting the insertion guide 21A into the guiding groove part 11CX.

Figure 10A:
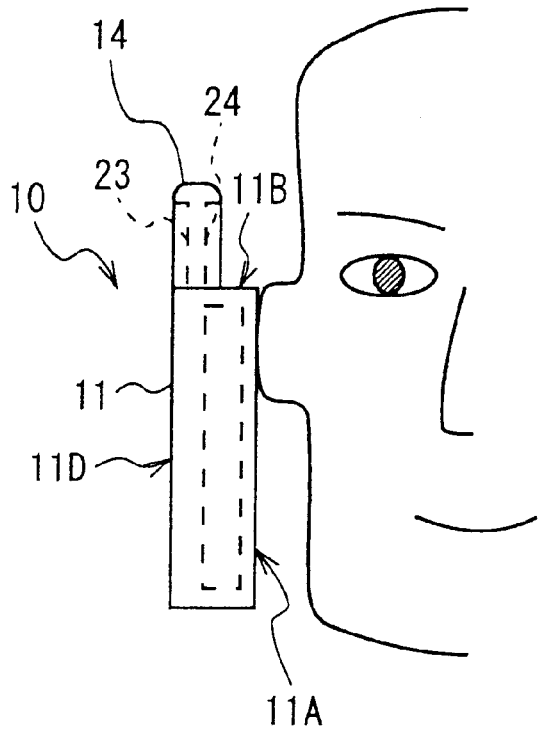
FIGS. 10A and 10B are outline views serving to explain a disposition of first and second antenna elements to a human body.
Figure 10B:
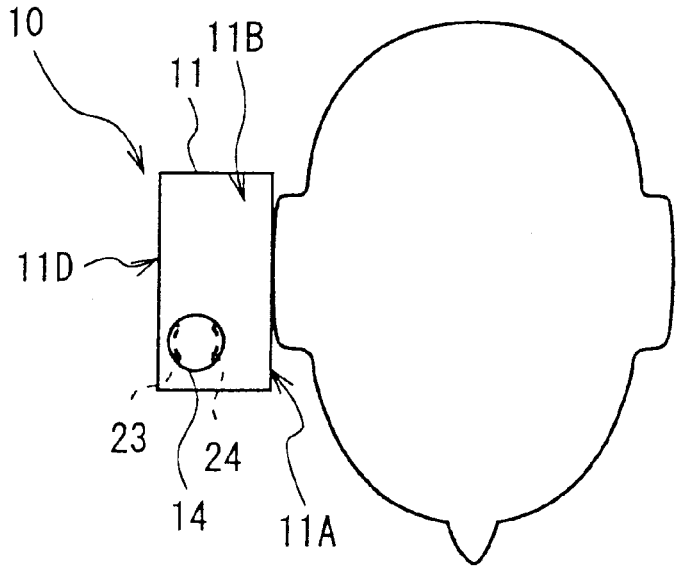

Thus, with this cellular phone 10, as shown in FIGS. 10A and 10B, the second antenna element 24 indicating a relatively low local average SAR in advance under the same disposing conditions can be disposed at the side of the front surface 11A of the casing case 11 and the first antenna element 23 indicating a relatively high local average SAR can be disposed securely at the side of the back surface 11D of the casing base 11.

Thereby, in the cellar phone 10, the first antenna element 23 can be securely kept the most distant from a human body during the telephone call, so that the local average SAR derived from electromagnetic waves irradiated from the first antenna element 23 can be reduced greatly.

Incidentally, with this cellular phone 10, provision of the insert mount hole 11C the nearest possible to the side of the back surface 11D in the casing case 11 permits the first and the second antenna elements 23 and 24 to be kept distant as a whole from a human body during the telephone call. In this way, the local average SAR derived from electromagnetic waves irradiated from the first antenna element 23 not only can be reduced still more greatly but the local average SAR derived from electromagnetic waves irradiated from the second antenna element 24 can also be reduced together.

According to the above arrangement, in a cellular phone 10, a first antenna element 23 is so positioned relative to the antenna casing 22 of an antenna apparatus 14 as to be situated at its back surface side and the first and second antenna elements 22 and 23 are glued.

And, in this cellular phone 10, an insertion guide 21A provided at the back surface side of the insert part 21 of the antenna case 22 was inserted through the guiding groove part 11CX of the insert mount hole 11C of the casing case 11, so that an antenna apparatus 14 was inserted in the casing case 11 while regulating the insertion posture of an antenna apparatus 14 so as to direct the back surface side of the antenna casing 22 toward the side of the back surface 11D of the casing case 11.

Thus, with this cellular phone 10, the second antenna element 24 not only can be disposed at the side of the front surface 11A of the casing case 11 but the first antenna element 23 can be disposed securely at the side of the back surface 11D thereof, with the result that the first antenna element 23 indicating a relatively high local average SAR can be kept the most distant from a human body during the telephone call.

Besides, with this cellular phone 10, a feeder line 26 related to a first antenna element 23 also acts as a radiative source if the first antenna element 23 is operated as an antenna, but the local average SAR derived from electromagnetic waves irradiated from the relevant feeder line 26 can also be reduced because the feeder line 26 is kept relatively distant from a human body during the telephone call by inserting the feeder line 26 into the line inserting hole part 20A near to the back surface of the antenna casing 22.

According to the above arrangement, the first antenna element 23 indicating a relatively high local average SAR is securely disposed at the side of the back surface 11D of the casing case 11 and can always be kept the most distant from a human body during the telephone call. This enables a cellular phone to be implemented which can greatly reduce the local average SAR derived from electromagnetic waves irradiated from the first antenna element 23 in such a degree as to keep the first antenna element 23 more distant from the human body during the telephone call.

(2) Second Embodiment

Figure 11:
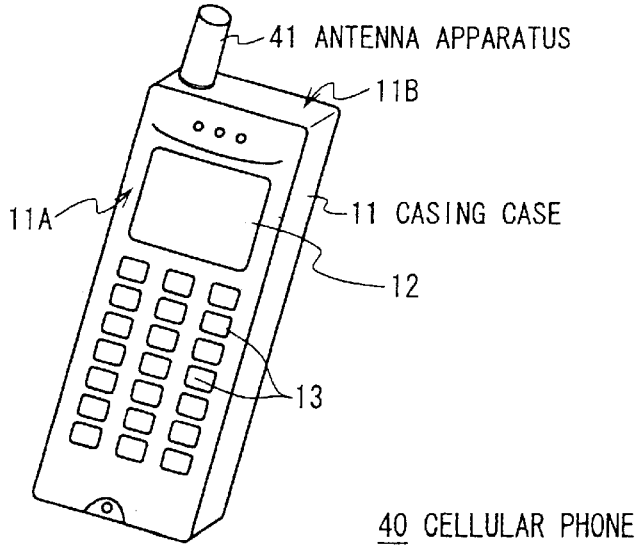
FIG. 11 is an outline perspective view showing a configuration of a cellular phone according to Second Embodiment.

FIG. 11 with like symbols attached to those corresponding to part of FIG. 2 shows a cellular phone 40 according to Second Embodiment, and is configured in a manner similar to a cellular phone 10 according to First Embodiment except for the configuration of an antenna apparatus 41.

Figure 12:
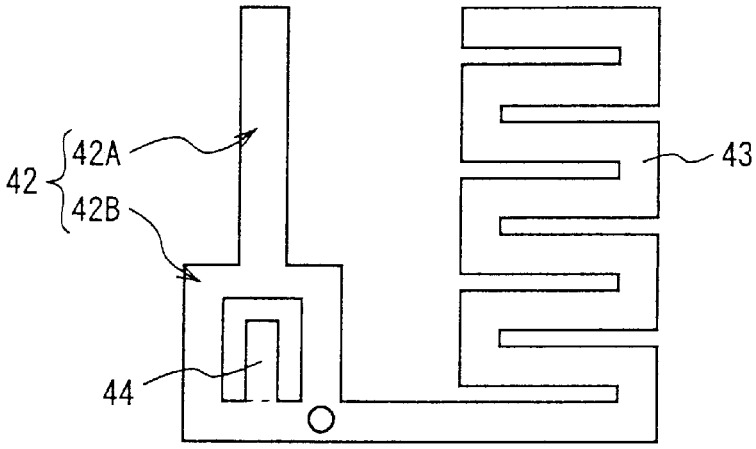
FIG. 12 is an outline plan view showing a configuration of first and second antenna elements.

In this case, as shown in FIG. 12, the antenna apparatus 41 comprises a first antenna element 42 with a broad frame portion 42B integrally formed of a conductive metal foil at the root of a band portion 42A and a second antenna element 43 formed of a conductive metal foil in the shape of a meander.

In this case, to a common feeding point present in the frame portion 42B of the first antenna element 42, a feeder line 44 formed of a conductive metal foil in the shape of a band is electrically connected in an arrangement of its length disposed on an extension in length of the band portion 42A. And the second antenna element 43 is electrically connected via the frame portion 42B of the first antenna element 42, both of which are integrated with the feeder line 44.

Incidentally, also in these first and second antenna elements 42 and 43, a local average SAR is measured in advance when they operate as an antenna at their corresponding first and second wireless communication frequencies under the same disposing conditions and as a result, the local average SAR is assumed to increase if the first antenna element 42 is operated as an antenna rather than the second antenna element 43.

Figure 13:
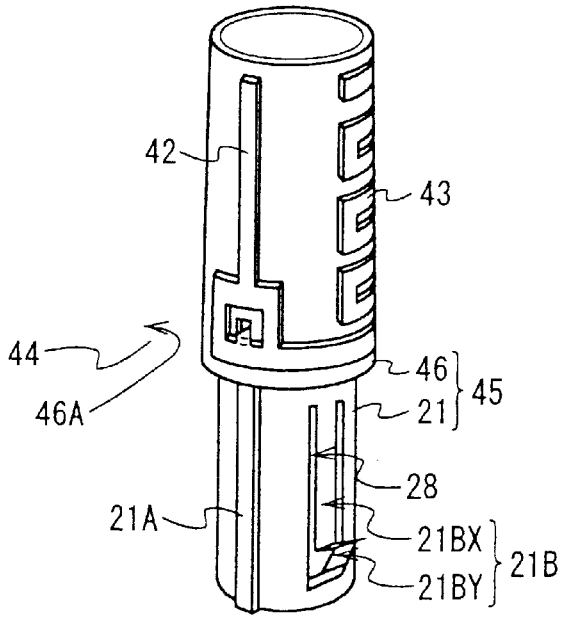
FIG. 13 is an outline perspective view showing a configuration of an antenna casing.

And, in FIG. 13 with like symbols attached to those corresponding to parts of FIG. 3, the antenna bobbin 46 of an antenna casing 45 is provided with a line inserting hole part 46A bored on an extension of the insertion guide 21A of the insert part 21.

Besides, in the line inserting hole part 46A, a feeder line 44 bent at a nearly right angle to the first and the second antenna elements 42 and 43 is inserted. There, the first antenna element 42 is positioned on the back surface of the antenna casing 45 and the second antenna element 43 is positioned on the front surface thereof, both of which are glued to the antenna bobbin 46.

In such a manner, this antenna casing 45 has the first antenna element 42, the feeding point and the insertion guide 21A all disposed in one line on its back surface.

Figure 14:
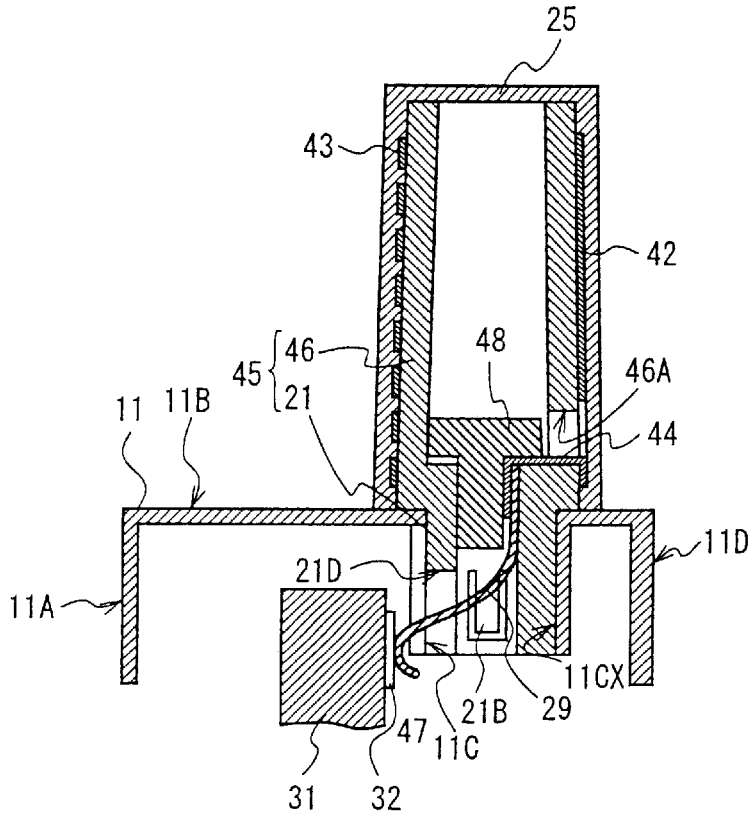
FIG. 14 is an outline sectional view serving to explain an insert mounting of an antenna apparatus to a casing case.

Besides, in FIG. 14 with like symbols attached to those corresponding to parts of FIG. 9, the antenna casing 45 has the other end side of a feeder spring 47 installed at the rear upper part of the internal surface of the insert part 21 which has a given elasticity and is pulled inside through the notch part 21D of the insert part 21.

And, the antenna casing 45 has the front end side of a feeder line 44 bent downward and brought into butt contact against the other end of the feeder spring 47 which is inserted in the line inserting hole part 46A. In this situation, a bush 48 formed of an elastic member such as rubber in a T-shaped section is inserted over an extent from the interior of the antenna bobbin 46 to that of the insert part 21 and mated with them.

Consequently, in the antenna casing 45, the feeder line 44 is pushed by the bush 48 to the other end of the feeder spring 47, thus electrically connecting the feeder spring 47 and the feeder line 44 to each other and fixing them.

Such being the case, as mentioned above by referring to FIG. 9, the antenna apparatus 41 allows the insert part 21 of the antenna casing 22 to be put in the insert mount hole 11C by inserting the insertion guide 21A through the guiding groove part 11CX and the respective corresponding nails 21BY and 21CY of the insertion fixing parts 21B and 21C in the insert part 21 are mated with the hollow parts 11CY and 11CZ in the insert mount hole 11C, thereby enabling the antenna apparatus 14 to be inserted in and mounted to the casing case 11.

Besides, at this time, the casing case 11 allows one end side of the feeder spring 47 to be brought almost into butt against the feeding electrode 32 of the circuit substrate 31, thus enabling the electrical connection.

In this way, a cellular phone 40 has not only the first antenna element 42 but the feeder line 44 also to be disposed at the back surface side of the casing case 11. In this way, the feeder line 44 irradiating electromagnetic waves can also be kept the most distant from a human body as well as the first and second antenna elements 42 and 43 during the telephone call.

With the above arrangement, the cellular phone 40 has a feeder line 44 provided in the frame portion 42B of the root of the first antenna element 42 and the feeder line 44 is inserted in the line inserting hole part 46A at the back surface of the antenna bobbin 46 of the antenna casing 45 and on an extension of the insertion guide 21A of the insert part 21 to position the first and second antenna elements 42 and 43, so that the first antenna element 42 is disposed at the back surface of the antenna bobbin 46, thus allowing the first and second antenna elements 42 and 43 to be glued to the antenna bobbin 46.

And, after electrically connecting the feeder line 48 to the feeder spring 47 at the back surface of the interior of the antenna casing 45, this cellular phone 40 is so arranged as to insert and mount the relevant antenna apparatus 41 in and to the casing case 11 while regulating the insertion posture of an antenna apparatus 41 so as to direct the back surface side of the antenna casing 45 toward the side of the back surface 11D of the casing case 11.

Thus, as with First Embodiment, this cellular phone 40 can dispose the second antenna element 43 at the side of the front surface 11A of the casing case 11, the first antenna element 42 securely at the side of the back surface 11D thereof and further the feeder line 44 securely at the side of the back surface 11D thereof as well. As a result, not only the first antenna element 42 indicating a relatively high local average SAR but the feeder line 44 operating as another antenna and indicating also a relatively high local average SAR can be kept the most distant from a human body during the telephone call.

According to the above arrangement in the present invention, the feeder line 44 operating as another antenna together with the first antenna element 42 and similarly indicating a relatively high local average SAR can also be kept the most distant from a human body during the telephone call in addition to the effect obtained by First Embodiment, thus enabling a cellular phone to be implemented which can still more greatly reduce the local average SAR during the telephone call.

(3) Other Embodiments

Incidentally, in First and Second Embodiments, a case where a second antenna element 24 or 43 is so arranged as to be disposed at the side of the front surface 11A of a casing case 11 was described, but the present invention is not limited to this and it is also allowable to keep second antenna elements 24 and 43 the nearest possible to first antenna elements 23 and 42 and moreover keep the second antenna elements 24 and 43 the most distant possible from a human body, thereby enabling the local average SAR observed when the second antenna elements 24 and 43 operate as an antenna to be reduced.

Furthermore, in First and Second Embodiments, a case where first and second antenna elements 23/42 and 24/43 formed of a conductive metal foil are so arranged as to be glued to the antenna bobbin 20/46 was described, but the present invention is not limited to this and first and second antenna elements can be formed according to various processes such as e.g. by forming first and second antenna elements formed of a conductive metal film on the antenna bobbin by the plating process or the deposition process.

Still further, in First and Second Embodiments, a case where two types of first and second antenna elements 23/42 and 24/43 were so arranged as to be used as an antenna element was described, but the present invention is not limited to this and at least two or more types of antenna elements can be so arranged as to be used corresponding to the number of used wireless communication system. Incidentally, in the case of using a plurality of antenna elements like this, a disposition of keeping an antenna element indicating the higher local average SAR the more distant from a human body under the same disposing conditions would enable the same effect as with First and Second Embodiments to be obtained.

Yet further, in First and Second Embodiments, a case where bushes 30 and 48 made of rubber are so arranged as to be used was described, but the present invention is not limited to this and if feeder lines 26 and 44 can be electrically connected to feeder springs 29 and 47, various other bushes such as metal materials subjected to insulating treatment can be used.

Yet further, in First and Second Embodiments, a case where the present invention is so arranged as to be applicable to the cellular phones 10 and 40 described above by referring to FIGS. 2 and 11 was described, but the present invention is not limited to this and can be widely applied to various other wireless communication apparatus such as transceiver and antenna apparatuss provided in these wireless communication apparatus if those are used near a human body during the telephone call.

Figure 15:
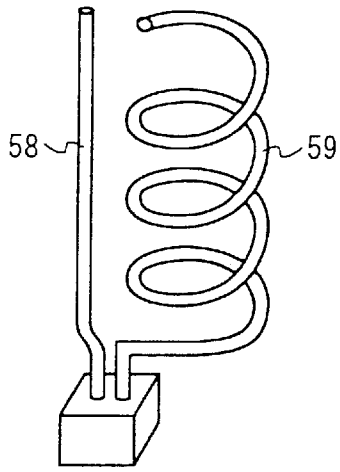
FIG. 15 is an outline perspective view showing a configuration of first and second antenna elements according to another embodiment.
Figure 16:
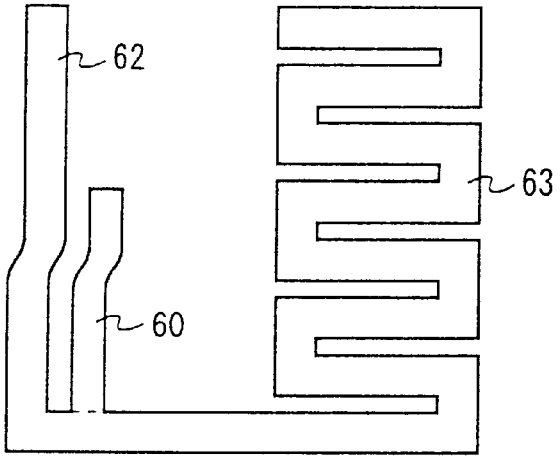
FIG. 16 is an outline perspective view showing a configuration of first and second antenna elements according to yet another embodiment.
Figure 17:
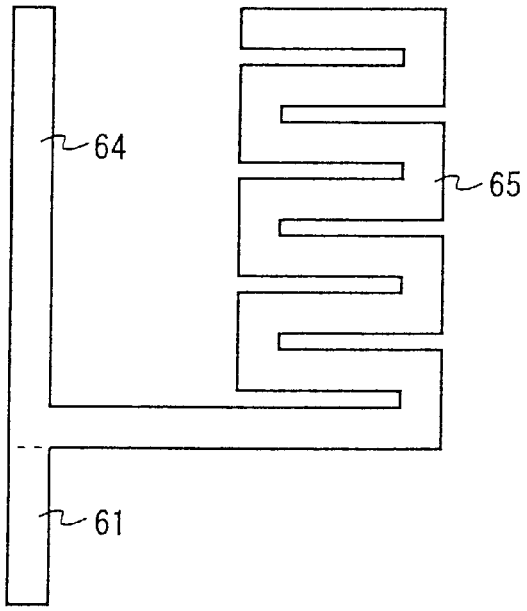
FIG. 17 is an outline perspective view showing a configuration of first and second antenna elements according to yet another embodiment.

Yet further, in First and Second Embodiments, a case where first and second antenna elements 23 and 24 as well as 42 and 43 formed of conductive metal foils mentioned above by referring to FIGS. 4 and 12 were so arranged as to be applicable to at least two or more antenna elements different in length was described, but the present invention is not limited to this and can be widely applied to various other antenna elements such as first and second antenna elements 58 and 59 formed of a conductive wire rod as shown in FIG. 15, first and second antenna elements 62 and 63 as well as 64 and 65 formed of a conductive metal into one piece in various patterns together with feeder lines 60 and 61 as shown in FIGS. 16 and 17 and antenna elements formed in various shapes such as shape of a meander or line.

Yet further, in First and Second Embodiments, a case where antenna casings 22 and 46 and an insert mount hole 11C of a casing case 11 are so arranged as to be applicable as antenna disposing means disposed to keep an antenna element indicating the higher absorption factor the more distant from a human body on the basis of the absorption factor of electromagnetic waves absorbed by the human body, measured in advance when individual antenna elements operate as antennas under the same disposing conditions, was described, but the present invention is not limited to this and is widely applicable to various other antenna disposing means if an antenna element indicating the higher absorption factor can be disposed the more distant from a human body on the basis of the absorption factor of electromagnetic waves absorbed by the human body, measured in advance when individual antenna elements operate as antennas under the same disposing conditions.

Yet further, in First and Second Embodiments, a case where cylindrical antenna casings 22 and 45 were so arranged as to be applicable as antenna hold means for holding all individual antenna elements collectively was described, but the present invention is not limited to this and is widely applicable to various other antenna hold means such as prism-shaped and elliptic antenna casing or one having an antenna hold substrate 67 with a first antenna element 68 provided on one surface 67A and a second antenna element 69 provided on the other surface 67B as shown in FIGS. 18A and 18B if capable of holding all individual antenna elements collectively.

Yet further, in First and Second Embodiments, a case where cylindrical insert parts 21 of antenna casings 22 and 45 and an insert mount hole 11C of a casing case 11 were so arranged as to be applicable as antenna installation means with antenna hold means installed was described, but the present invention is not limited to this and is widely applicable to installation means comprising a cylindrical insert part formed in the shape of approximately D and an insert mount hole in the corresponding shape of a casing case, installation means comprising an installation plate-shaped member 71 provided on an antenna casing 70 and a pedestal 73 with this member 71 fixed via a screw 72 as shown in FIG. 19 or various other installation means if capable of installing antenna hold means.

Yet further, in First and Second Embodiments, there was described a case where line inserting mount hole parts 20A and 46A of antenna bobbins 20 and 46 and feeder lines 26 and 44 were so arranged as to be applied as antenna positioning means for positioning individual antenna elements to be held by antenna hold means so as to line up in decreasing order of absorption factor indicated by antenna elements, but the present invention is not limited to this and is widely applicable to other antenna positioning means of various configurations if individual antenna elements to be held by antenna hold means can be positioned so as to line up in decreasing order of absorption factor indicated by antenna elements.

Figure 20:
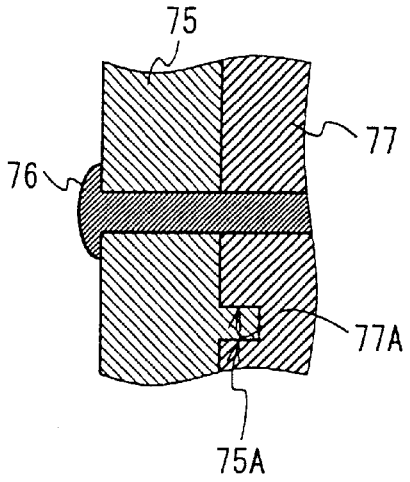
FIG. 20 is an outline sectional view serving to explain a regulation of an installation posture according to another embodiment.
Figure 21:
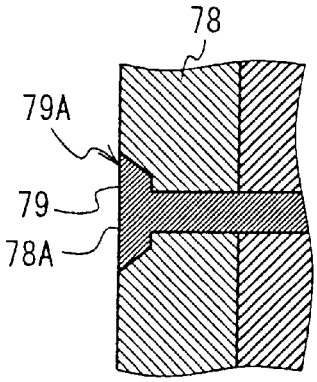
FIG. 21 is an outline sectional view serving to ex plain a regulation of an installation posture according to yet another embodiment.

Yet further, in First and Second Embodiments, there was described a case where insertion guide 21A provided at insert parts 21 of antenna casings 22 and 45 and a guiding groove part 11CX provided in insert mount hole 11C of a casing case 11 were so arranged as to be applied as posture regulation means for regulating the installation posture of antenna hold means to installation means so as to keep an antenna element indicating the higher absorption factor the more distant from a human body, but the present invention is not limited to this and is widely applicable to posture regulation means comprising a protruding portion 75A of an installation plate-shaped member 75 provided in an antenna casing (unillustrated) and a corresponding recessed portion 77A provided in a plate material 77 such as a circuit substrate to which the plate-shaped member 75 is installed via a screw 76 as shown in FIG. 20, posture regulation means comprising a recessed portion 78A formed in accordance with a head 79A of an oval countersunk screw 79 in an installation plate-shaped member 78 provided in an antenna casing (unillustrated) or various other posture regulation means as shown in FIG. 21 if the installation posture in antenna hold means to installation means can be so regulated as to keep an antenna element indicating the higher absorption factor the more distant from the human body.

While there has been described in connection with the preferred embodiments of the invention, it will be obvious to those skilled in the art that various changes and modifications may be aimed, therefore, to cover in the appended claims all such changes and modifications as fall within the true spirit and scope of the invention.

What is claimed is:

1. An antenna apparatus comprising:

two antenna elements respectively different in electrical length for receiving signals of different respective frequencies; and antenna disposing means for disposing a one of said two antenna elements indicating a higher absorption factor more distant from a human body than the other of said two antenna elements, on the basis of the absorption factor of electromagnetic waves absorbed by said human body, measured in advance when said two antenna elements operate respectively as antennas under the same disposing conditions.

2. The antenna apparatus according to claim 1 wherein said two antenna elements are electrically connected to a common feeding point.

3. The antenna apparatus according to claim 2 wherein said antenna disposing means comprises:

antenna hold means for holding said two antenna elements collectively; and installation means to which said antenna hold means is installed.

4. The antenna apparatus according to claim 3 further comprising antenna positioning means for positioning said two antenna elements held by said antenna hold means in such an arrangement ordered in sequence from a higher to a lower absorption factor thereof.

5. The antenna apparatus according to claim 4 further comprising posture regulation means for regulating an installation posture of said antenna hold means to said installation means so as to keep said antenna element indicating a higher absorption factor the more distant from said human body.

6. An antenna apparatus according to claim 5 wherein said antenna element indicating the higher absorption factor has a given location serving for said common feeding point and a feeder line electrically connected to a feeding point together with the other of said two antenna elements and said antenna hold means holds said feeder line the most distant from said human body.

7. A wireless communication apparatus using two types of wireless communication systems using respectively two different wireless communication frequencies, said apparatus comprising:

two antenna elements different in respective electrical length corresponding to said two wireless communication frequencies; and antenna disposing means for disposing a one of said two antenna elements indicating a higher absorption factor at a greater distance from a user's body on the basis of the absorption factor of electromagnetic waves absorbed by said user's body, measured in advance when said two antenna elements operate respectively as antennas under the same disposing conditions.

8. The wireless communication apparatus according to claim 7 wherein said two antenna elements are electrically connected to a common feeding point.

9. The wireless communication apparatus according to claim 8 wherein said antenna disposing means comprises:

antenna hold means for holding said two antenna elements collectively; and installation means to which said antenna hold means is installed.

10. The wireless communication apparatus according to claim 9 further comprising antenna positioning means for positioning said two antenna elements to be held by said antenna hold means in such an arrangement ordered in sequence from a higher to a lower absorption factor thereof.

11. The wireless communication apparatus according to claim 10 further comprising posture regulation means for regulating an installation posture of said antenna hold means to said installation means so as to keep said antenna element indicating a higher absorption factor the more distant from said human body.

12. The wireless communication apparatus according to claim 11 wherein said antenna element indicating the higher absorption factor has a given location serving for said common feeding point and a feeder line electrically connected to the feeding point together with the other of said two antenna elements and said antenna hold means holds said feeder line the most distant from said human body.

* * * * *